US011913443B2

(12) United States Patent
Wilde et al.

(10) Patent No.: US 11,913,443 B2
(45) Date of Patent: Feb. 27, 2024

(54) PUMPING APPARATUS FOR DISPENSING A FLOWABLE PRODUCT

(71) Applicant: Hodges & Drake Design Ltd, Leicester (GB)

(72) Inventors: Ronan Wilde, Leicestershire (GB); Kevin Hodges, Leicester (GB)

(73) Assignee: HODGES & DRAKE DESIGN LTD, Leicester (GB)

( * ) Notice: Subject to any disclaimer, the term of this patent is extended or adjusted under 35 U.S.C. 154(b) by 731 days.

(21) Appl. No.: 17/042,666

(22) PCT Filed: Mar. 28, 2019

(86) PCT No.: PCT/GB2019/050898

§ 371 (c)(1),
(2) Date: Sep. 28, 2020

(87) PCT Pub. No.: WO2019/186176

PCT Pub. Date: Oct. 3, 2019

(65) Prior Publication Data

US 2021/0140421 A1 May 13, 2021

(30) Foreign Application Priority Data

Mar. 29, 2018 (GB) ..... 1805144

(51) Int. Cl.
*F04B 43/08* (2006.01)
*F04B 43/12* (2006.01)

(52) U.S. Cl.
CPC ..... *F04B 43/1292* (2013.01); *F04B 43/086* (2013.01)

(58) Field of Classification Search
CPC .. F04B 43/08; F04B 43/1136; F04B 43/1292; F04B 43/088; F04B 43/12;
(Continued)

(56) References Cited

U.S. PATENT DOCUMENTS 3,489,525 A * 1/1970 Natelson ..... F04B 43/1292 137/118.01
4,519,754 A * 5/1985 Minick ..... F04B 43/1284 417/477.11

(Continued)

FOREIGN PATENT DOCUMENTS

EP 1184071 A1 3/2002
JP 2000185092 A 7/2000
RU 2086111 C1 12/1996

OTHER PUBLICATIONS

Russian Search Report Corresponding with Application No. 2020135325 dated Aug. 5, 2022 (2 pages).

(Continued)

*Primary Examiner* — Philip E Stimpert
*Assistant Examiner* — Dnyanesh G Kasture
(74) *Attorney, Agent, or Firm* — Dority & Manning, P.A.

(57) ABSTRACT

A pumping apparatus 1 for dispensing a flowable product comprises first and second peristaltic pumps 12, 14. The first peristaltic pump 12 comprises a first rotor 18 having at least one pressing member 20, a first cylindrical stator 19 in which the first rotor 18 is rotatable and first flexible tubing 30 extending circumferentially around the first stator 19 against a first inner wall 19*a*. The second peristaltic pump 14 comprises a second rotor 42 having at least one pressing member 46, a second cylindrical stator 44 in which the second rotor 42 is rotatable and second flexible tubing 54 extending circumferentially around the second stator 44 against a second inner wall 44*a*. The first and second inner walls 19*a*, 44*a* each have a first and second radius r1, r2 respectively with the first radius r1 being greater than the second radius r2, and at least one of the stators 19, 44 is movable relative to the other stator 19, 44.

20 Claims, 14 Drawing Sheets

(58) Field of Classification Search
CPC .. F04B 43/1284; F04B 45/08; F04B 43/0009; F04B 23/04–23/14; F04B 53/16
USPC ..... 417/477.9, 477.11
See application file for complete search history.

(56) References Cited

U.S. PATENT DOCUMENTS

| | | | | |
|---|---|---|---|---|
| 5,571,389 | A * | 11/1996 | Kerampran | C25D 5/026 204/278 |
| 5,709,539 | A | 1/1998 | Hammer | |
| 7,997,448 | B1 | 8/2011 | Leyva | |
| 9,518,576 | B1 * | 12/2016 | Wiederin | F04B 43/1223 |
| 2005/0109795 | A1 * | 5/2005 | Furey | F04B 43/1253 222/63 |
| 2005/0159696 | A1 * | 7/2005 | Bernard | A61M 1/367 604/6.16 |
| 2005/0238515 | A1 | 10/2005 | Kent | |
| 2007/0059184 | A1 | 3/2007 | Bach | |
| 2009/0092507 | A1 * | 4/2009 | Ramirez, Jr. | F04B 43/1253 417/410.1 |
| 2015/0298123 | A1 * | 10/2015 | Block, III | F04B 43/0054 435/284.1 |
| 2016/0123317 | A1 * | 5/2016 | Ackermann | F04B 43/1261 417/476 |
| 2018/0186656 | A1 * | 7/2018 | Drewniak | C02F 5/125 |
| 2019/0017011 | A1 * | 1/2019 | Patil | C12M 41/48 |

OTHER PUBLICATIONS

Russian Office Action Corresponding with Application No. 2020135325 dated Aug. 8, 2022.
International Patent Application No. PCT/GB2019/050898; International Search Report; dated Jun. 28, 2019; (2 pages).
GB Patent Application No. GB1805144.1; Search Report; dated Sep. 28, 2018; (1 page).

* cited by examiner

PUMPING APPARATUS FOR DISPENSING A FLOWABLE PRODUCT

PRIORITY CLAIM

This application is a National Stage Application of PCT/GB2019/050898, filed on Mar. 28, 2019, which claims the benefit of priority to GB Patent Application No. 1805144.1, filed on Mar. 29, 2018, the disclosures of all of which are incorporated by reference herein in their entireties.

TECHNICAL FIELD

The present disclosure relates generally to the dispensing of flowable products and in particular to a pumping apparatus for dispensing a flowable product. Embodiments of the present disclosure relate in particular, but not exclusively, to the dispensing of relatively viscous liquids. Embodiments of the present disclosure provide a pumping apparatus for dispensing accurate amounts of a flowable product through the use of first and second peristaltic pumps having different diameters.

TECHNICAL BACKGROUND

Peristaltic pumps are well-known in the art and are generally used to pump liquids. In a conventional peristaltic pump, flexible tubing is compressed between a stator and a rotor having one or more pressing members, and liquid is conveyed through the flexible tubing by peristaltic action as the rotor rotates. Peristaltic pumps can be used in a variety of applications and are of particular use when the flow of liquid needs to be carefully metered and where contamination of the liquid needs to be avoided. Peristaltic pumps are extensively used in medical applications, for example to deliver intravenous (IV) liquids to a patient, and also in food and beverage applications, for example to dispense a predetermined quantity of a beverage or a component of a beverage such as a liquid flavouring. Peristaltic pumps are also suitable for pumping viscous liquids.

It has been previously been suggested, for example in U.S. Pat. No. 7,997,448 B1, that liquids may be able to be dispensed more accurately by a pumping apparatus having at least two peristaltic pumps. In U.S. Pat. No. 7,997,448 B1, the rotors of the peristaltic pumps are co-axially aligned and driven by a single shaft using clutches and this results in a complex and bulky apparatus. The present disclosure seeks to provide an improved pumping apparatus.

SUMMARY OF THE DISCLOSURE

According to a first aspect of the present disclosure, there is provided a pumping apparatus for dispensing a flowable product, the apparatus comprising:

- a first peristaltic pump comprising:
  - a first drivable rotor having at least one pressing member;
  - a first cylindrical stator in which the first rotor is rotatable, the first stator having a first circumferential inner wall with a first radius;
  - first flexible tubing having an inlet side and an outlet side, the first flexible tubing extending circumferentially around the first stator against the first inner wall;
- a second peristaltic pump comprising:
  - a second drivable rotor having at least one pressing member;

- a second cylindrical stator in which the second rotor is rotatable, the second stator having a second circumferential inner wall with a second radius;
  - second flexible tubing having an inlet side and an outlet side, the second flexible tubing extending circumferentially around the second stator against the second inner wall;
- wherein the first radius is greater than the second radius and at least one of the stators is movable relative to the other stator.

By providing a pumping apparatus in which the radius of the first stator is greater than the radius of the second stator, the first peristaltic pump can be operated to dispense large quantities of flowable product in a relatively short amount of time whilst the second peristaltic pump can be operated, usually after terminating the operation of the first peristaltic pump, to dispense smaller quantities of flowable product with a greater degree of accuracy.

The first and second rotors may each have an axis of rotation and the axes of rotation may be substantially parallel with each other and may be spaced apart from each other. The first and second rotors may be engageable by separate first and second external drives whose axes of rotation may also be substantially parallel with each other and may be spaced apart from each other. By movably mounting at least one of the stators, and hence its associated rotor, relative to the other stator and its associated rotor, correct engagement of the first and second rotors with the first and second external drives can be assured. This removes the need for precise positioning and alignment of the first and second stators, and hence of the first and second rotors, during fabrication of the pumping apparatus.

At least one of the stators may be movable towards or away from the other stator. At least one of the stators may be movable relative to the other stator in the same plane. The first and second stators may be coplanar. The first and second rotors may be coplanar.

The apparatus may comprise a pump housing.

At least one of the stators may be mounted on or in the pump housing for movement relative to the other stator. Movement of at least one of the stators permits movement of its associated rotor and, hence, ensures that alignment and engagement of the rotors with the first and second external drives can be assured.

Both of the stators may be mounted on or in the pump housing for movement relative to each other. Movement of both stators permits movement of the associated rotors and may further facilitate alignment and engagement of the rotors with the first and second external drives.

At least one of the stators may be formed by the pump housing and the other stator may be mounted on or in the pump housing for movement relative to the pump housing. An arrangement in which at least one of the stators, namely the non-movable stator, is formed by the pump housing may simplify fabrication of the pumping apparatus.

The first stator may be formed by the pump housing and the second stator may be mounted on or in the pump housing. With this arrangement, the larger diameter stator associated with the first peristaltic pump may be formed by the pump housing whereas the smaller diameter stator associated the second peristaltic pump may be mounted on or in the pump housing. Alternatively, the first stator may be mounted on or in the pump housing and the second stator may be formed by the pump housing. With this arrangement, the larger diameter stator associated with the first peristaltic pump may be mounted on or in the pump housing whereas the smaller diameter stator associated with the second peristaltic pump may be formed by the pump housing.

The at least one movable stator may comprise a stator block which may be movable relative to the pump housing. The apparatus may comprise retaining means for retaining the stator block on or in the pump housing and the retaining means may be arranged to permit movement of the stator block relative to the pump housing. Providing the movable stator in the form of a stator block may simplify fabrication of the pumping apparatus.

The pump housing may comprise first and second housing parts which may be movable relative to each other. The first and second stators may be formed by the first and second housing parts. With this arrangement, movement of the first and second housing parts permits the aforementioned relative movement of the first and second stators and their associated rotors to facilitate alignment and engagement of the rotors with the first and second external drives.

The first radius may be at least 20% greater than the second radius. The first radius may be at least 50% greater than the second radius. The first radius may be at least 100% greater than the second radius. The ratio of the first and second radiuses can be selected to provide a trade-off between the ability of the first pump, with its larger radius, to dispense relatively large quantities of flowable product in a relatively short amount of time and the ability of the second pump, with its smaller radius, to dispense smaller quantities of flowable product with a greater degree of accuracy.

The first flexible tubing and the second flexible tubing may have the same diameter. Thus, the pumping characteristics of the first and second peristaltic pumps are governed solely by the differing diameters of the first and second stators and their associated first and second rotors.

A diameter, and in particular an internal diameter, of the first flexible tubing may differ from, and may be greater than, a diameter of the second flexible tubing by at least 20%. The diameter of the first flexible tubing may differ from, and may be greater than, the diameter of the second flexible tubing by at least 50%. The diameter of the first flexible tubing may differ from, and may be greater than, the diameter of the second flexible tubing by at least 100%. The larger diameter flexible tubing may contribute to the ability of the first peristaltic pump, with its larger stator radius, to dispense relatively large quantities of flowable product in a relatively short amount of time whilst the smaller diameter flexible tubing may contribute to the ability of the second pump, with its smaller stator radius, to dispense smaller quantities of flowable product with a greater degree of accuracy.

The apparatus may comprise a first product outlet connector at the outlet side of the first flexible tubing and may comprise a second product outlet connector at the outlet side of the second flexible tubing. The first product outlet connector may have an outlet axis and the second product outlet connector may have an outlet axis. The outlet axes of the first and second product outlet connectors may be substantially parallel with the rotational axes of the first and second rotors. The first and second product outlet connectors may be mounted on or in the pump housing and may be movable relative to the pump housing, for example in the same plane as the movable first and/or second stator. By movably mounting the first and second product outlet connectors relative to the pump housing and, hence, relative to the first and/or second stators and associated rotor(s), correct alignment of the first and second product outlet connectors with externally mounted cooperating first and second product inlet connectors can be assured. A liquid tight connection between the first and second product outlet connectors and each of the respective externally mounted first and second product inlet connectors can be assured and damage or wear caused by misalignment can be avoided, or at least minimised. Further, movably mounting the first and second product outlet connectors relative to the pump housing removes the need for precise positioning and alignment of the first and second product outlet connectors during fabrication of the pumping apparatus.

The first product outlet connector may comprise a push-fit connector and the second product outlet connector may comprise a push-fit connector. This form of connector may be particularly suited for use with externally mounted cooperating first and second push-fit product inlet connectors.

The first flexible tubing may include a first product outlet at the outlet side thereof, the second flexible tubing may include a second product outlet at the outlet side thereof, and the first and second product outlets may be configured to dispense the flowable product directly into a receptacle, and more particularly into a common receptacle. By dispensing the flowable product directly from the first and second product outlets at the outlet side of each of the first and second flexible tubing, the need for external tubing (i.e. tubing that does not form part of the pumping apparatus) to perform the dispensing operation is avoided, thereby avoiding the need to clean or sanitize the external tubing in circumstances where it is used to dispense different flowable products.

The first product outlet and the second product outlet may have the same inner diameter. This may be advantageous in embodiments in which the first and second flexible tubing have the same inner diameter.

The first product outlet and the second product outlet may have a different inner diameter. This may be advantageous in embodiments in which the first flexible tubing and the second flexible tubing have a different inner diameter.

The inner diameter of the first product outlet may be greater than the inner diameter of the second product outlet. This may be advantageous in embodiments in which the inner diameter of the first flexible tubing is greater than the inner diameter of the second flexible tubing.

The inner diameter of the first product outlet may be greater than the inner diameter of the second product outlet by at least 20%, possibly by at least 50%, and possibly by at least 100%.

The first and second product outlets may comprise respectively first and second dispensing nozzles. The first and second dispensing nozzles may comprise respectively first and second dispensing needles.

The first and second product outlets may be mountable on a support. A plurality of said pumping apparatus may be provided to form a pumping system, and the first and second product outlets of each of the pumping apparatus may be mountable on a support to form an array of first and second product outlets which may be arranged to dispense flowable product directly into a common receptacle.

The pumping apparatus may comprise a single flowable product source and the inlet side of the first flexible tubing and the inlet side of the second flexible tubing may each be in fluid communication with the single flowable product source. This provides a simple and convenient arrangement for dispensing flowable product from a single flowable product source.

The single flowable product source may comprise a flowable product reservoir. The single flowable product source may comprise an air-tight flexible pouch containing the flowable product.

The single flowable product source may be removably mounted on the pump housing. When the supply of flowable product in a single flowable product source has been depleted, it can be removed from the pump housing and a replacement single flowable product source can be mounted on the pump housing. With this arrangement, the depleted single flowable product source can be discarded whilst the pump housing and the associated first and second peristaltic pumps are used for further dispensing operations.

The single flowable product source may be permanently mounted on the pump housing. The single flowable product source and the pump housing may be positioned in a container which may be formed of a rigid material, for example corrugated cardboard. When the supply of flowable product in a single flowable product source has been depleted, the first and second rotors can be disengaged from the first and second external drives by removing the container. A replacement container comprising a single flowable product source and associated pump housing can then be positioned so that the first and second rotors of the first and second peristaltic pumps are engaged with the first and second external drives.

The pumping apparatus may comprise a first flowable product source and a second flowable product source which is not in fluid communication with the first flowable product source. The inlet side of the first flexible tubing may be in fluid communication with the first flowable product source and the inlet side of the second flexible tubing may be in fluid communication with the second flowable product source. This arrangement permits the dispensing of flowable product from separate flowable product sources. The first flowable product source and the second flowable product source may contain the same flowable product. The first flowable product source and the second flowable product source may alternatively contain different flowable products.

The first flowable product source and/or the second flowable product source may comprise flowable product reservoirs. The first flowable product source and/or the second flowable product source may comprise air-tight flexible pouches.

DETAILED DESCRIPTION OF EMBODIMENTS

Embodiments of the present disclosure will now be described by way of example only and with reference to the accompanying drawings.

Figure 1A:
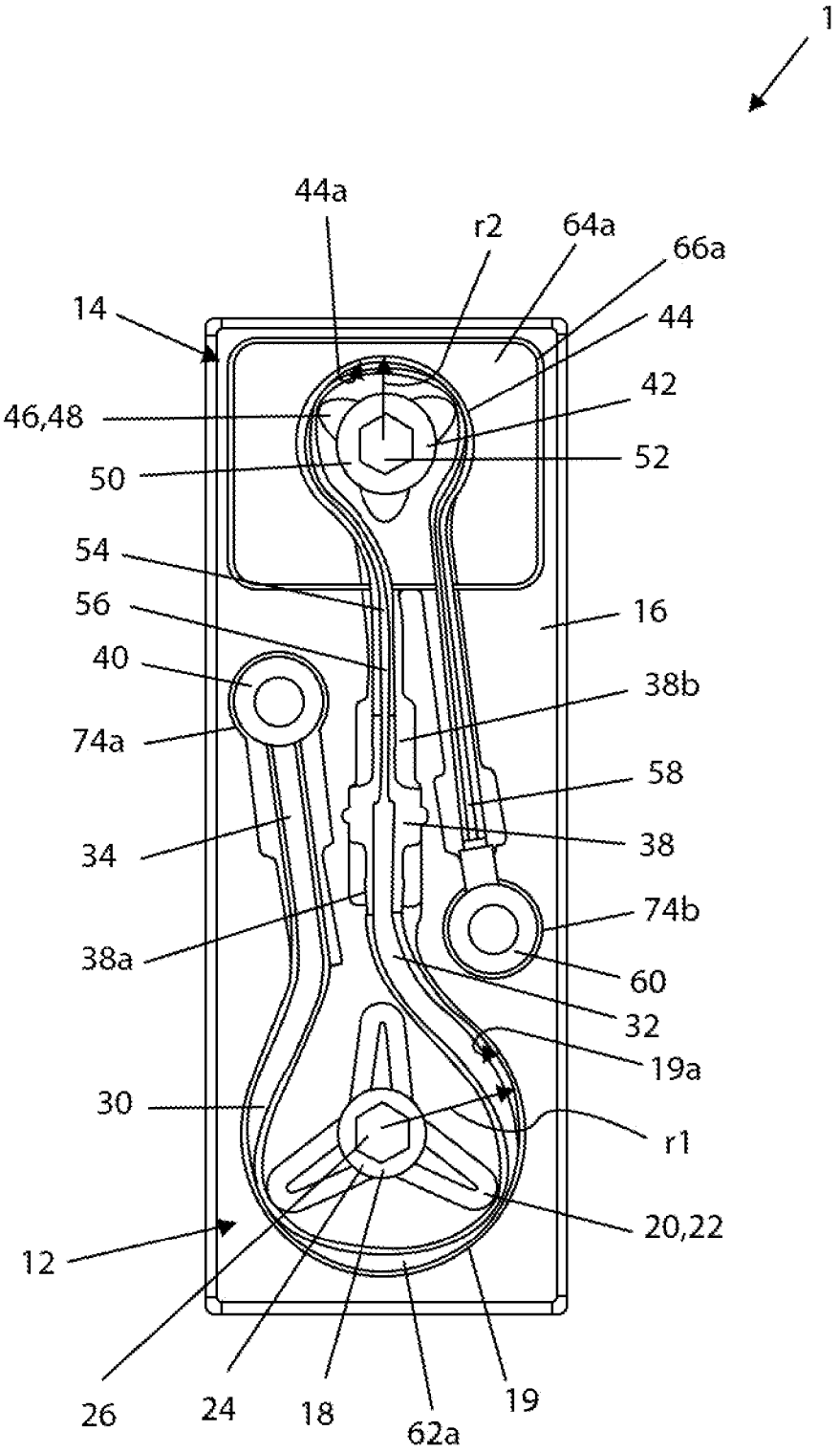
FIGS. 1*a* and 1*b* are diagrammatic illustrations of a first embodiment of a pumping apparatus.
Figure 1B:
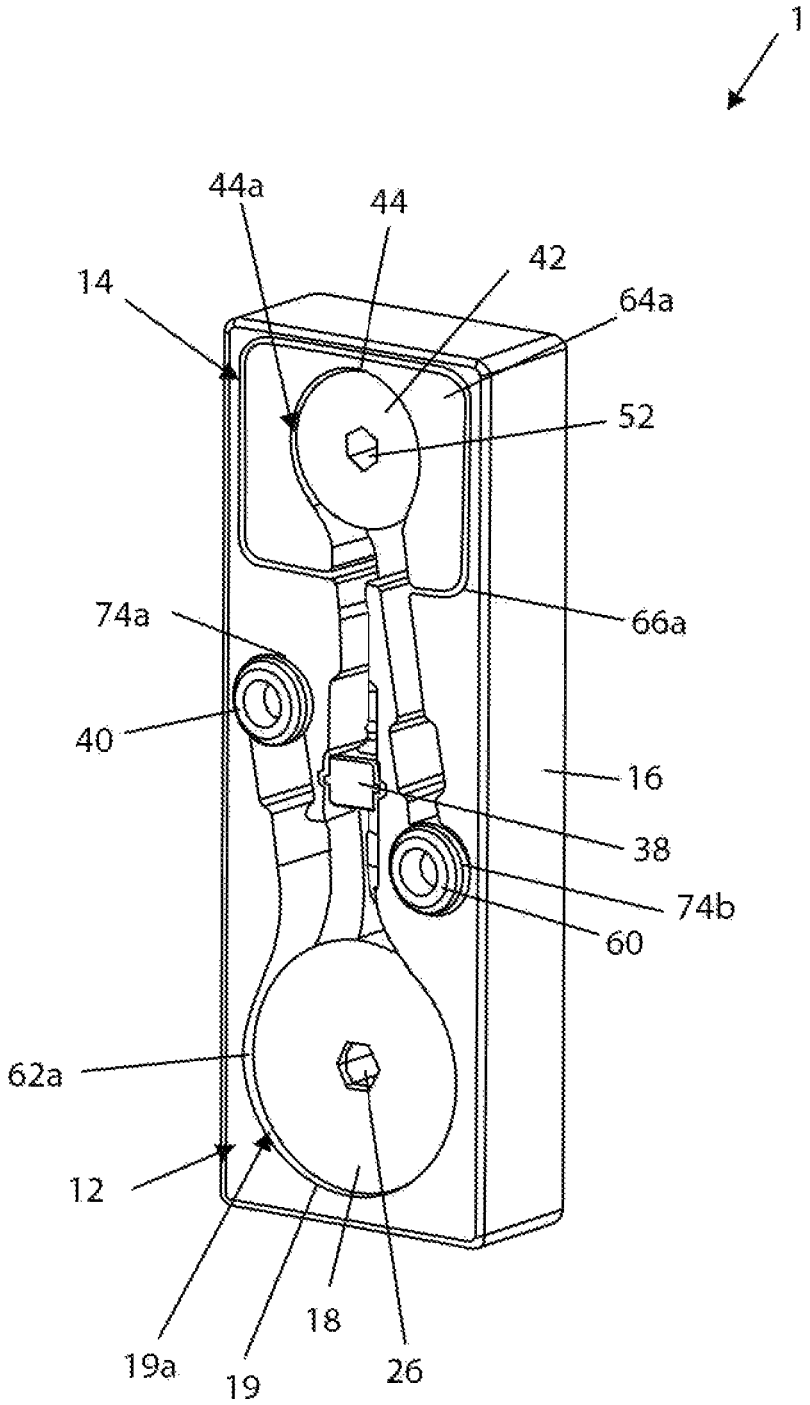
Figure 2:
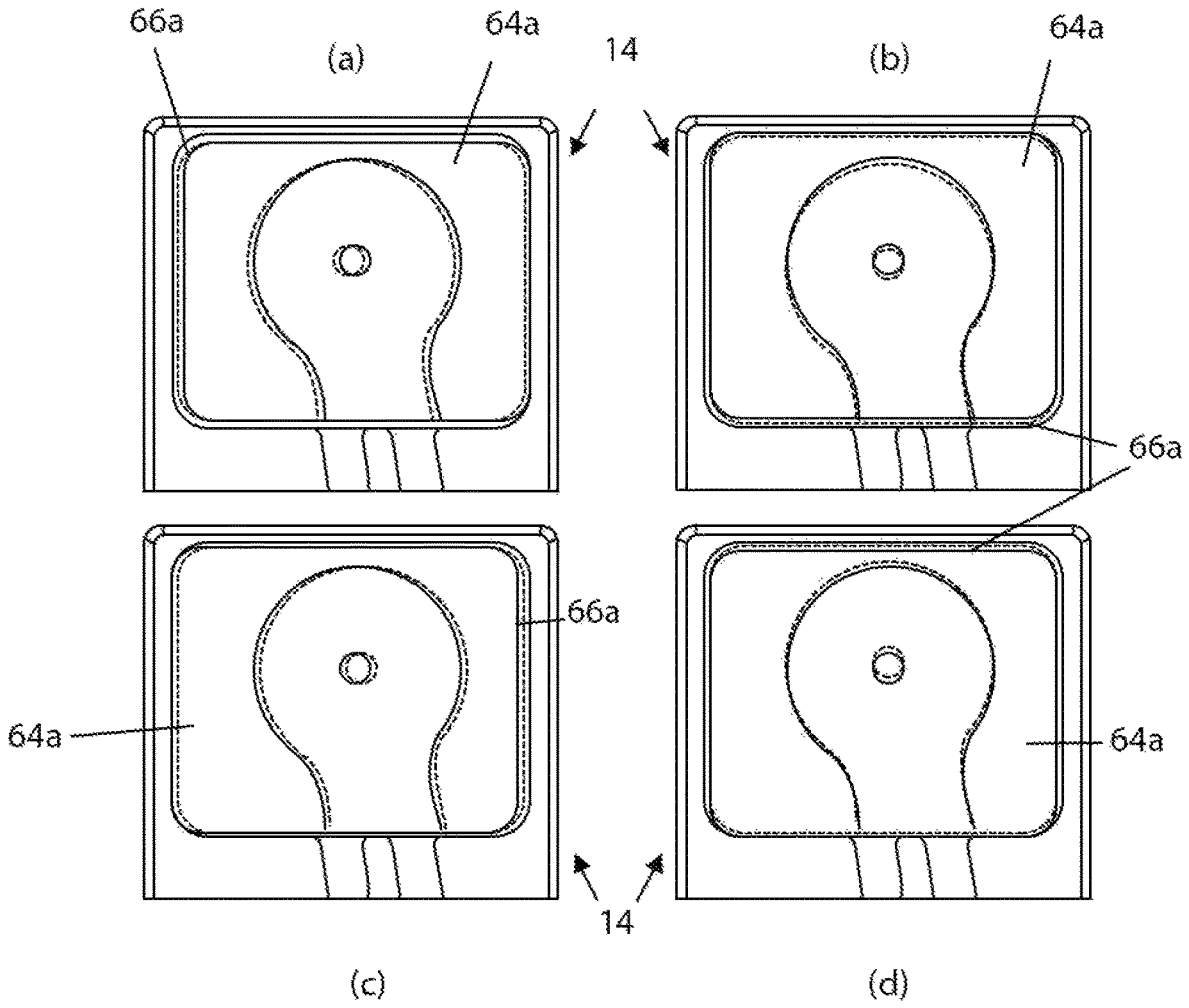
FIGS. 2*a* to 2*d* are diagrammatic illustrations showing the movement of a stator block of the pumping apparatus of FIGS. 1*a* and 1*b;*

Referring initially to FIGS. 1*a* and 1*b*, a pumping apparatus 1 comprises a first peristaltic pump 12, a second peristaltic pump 14 and a pump housing 16.

The first peristaltic pump 12 includes a first rotor 18, typically formed of a moulded substantially rigid plastics material, and a first cylindrical stator 19 in which the first rotor 18 is rotatably mounted. The first rotor 18 includes a plurality of pressing members 20 in the form of lobes 22 which are integrally formed with, and project radially outwardly from, a first spindle 24 and which are equally spaced around the circumference of the first spindle 24. In the illustrated embodiment, the first rotor 18 includes three lobes 22 but it will be appreciated that the first rotor 18 can include any suitable number of lobes 22. It will also be appreciated that other types of pressing members 20, for example rollers, can be used. The first spindle 24 includes a central drive aperture 26 which can be engaged by a first external rotary drive 28*a* (FIGS. 10 and 11), such as the drive shaft of an electric motor.

The first peristaltic pump 12 includes first flexible tubing 30 which can be formed of any suitable resilient plastics material such as polyvinyl chloride. The first flexible tubing 30 has an inlet side 32 through which flowable product, such as a viscous liquid, is delivered to the first peristaltic pump 12 and an outlet side 34 through which flowable product is delivered from the first peristaltic pump 12. The inlet side 32 and outlet side 34 are designated with respect to the normal direction of rotation of the first rotor 18 (clockwise in FIG. 1*a*). The inlet side 32 is connected to a first outlet port 38*a* of an outlet manifold 38 and the outlet side 34 is connected to a first product outlet connector 40. The first flexible tubing 30 extends circumferentially around the first cylindrical stator 19 against an inner wall 19*a* and the inlet side 32 and the outlet side 32 extend outwardly away from the first cylindrical stator 19 in a substantially radial direction.

The second peristaltic pump 14 includes a second rotor 42, typically formed of a moulded substantially rigid plastics material, and a second cylindrical stator 44 in which the second rotor 42 is rotatably mounted. The second rotor 42 includes a plurality of pressing members 46 in the form of lobes 48 which are integrally formed with, and project radially outwardly from, a second spindle 50 and which are equally spaced around the circumference of the second spindle 50. In the illustrated embodiment, the second rotor 42 includes three lobes 48 but it will be appreciated that the second rotor 42 can include any suitable number of lobes 48. It will also be appreciated that other types of pressing members 46, for example rollers, can be used. The second spindle 50 includes a central drive aperture 52 which can be engaged by a second external rotary drive 28*b* (FIGS. 10 and 11), such as the drive shaft of an electric motor.

The second peristaltic pump 14 includes second flexible tubing 54 which can be formed of any suitable resilient plastics material such as polyvinyl chloride. The second flexible tubing 54 has an inlet side 56 through which flowable product, such as a viscous liquid, is delivered to the second peristaltic pump 14 and an outlet side 58 through which the flowable product is delivered from the second peristaltic pump 14. The inlet side 56 and outlet side 58 are designated with respect to the normal direction of rotation of the second rotor 42 (clockwise in FIG. 1*a*). The inlet side 56 is connected to a second outlet port 38*b* of the outlet manifold 38 and the outlet side 58 is connected to a second product outlet connector 60. The second flexible tubing 54 extends circumferentially around the second cylindrical stator 44 against an inner wall 44*a* and the inlet side 56 and the outlet side 58 extend outwardly away from the second cylindrical stator 44 in a substantially radial direction.

The first cylindrical stator 19 has a first radius r1 and the second cylindrical stator 44 has a second radius r2. The first radius r1 is greater than the second radius r2, typically at least 20% greater. In addition, in the illustrated embodiment, the first flexible tubing 30 has a diameter, and in particular an inner diameter, which is greater than a diameter, and in particular an inner diameter, of the second flexible tubing 54. As explained earlier in the specification, the different diameters of the first and second stators 19, 44 and their associated first and second rotors 18, 42, and optionally the different diameters of the first and second flexible tubing 30, 54 of the first and second peristaltic pumps 12, 14, provides each of the pumps 12, 14 with different pumping characteristics. In particular, the larger first pump 12 with its larger diameter first flexible tubing 30 is capable of delivering large quantities of liquid or other flowable product in a relatively short amount of time whereas the smaller second pump 14 with its smaller diameter second flexible tubing 54 is capable of delivering smaller quantities of the liquid or other flowable product but with a higher degree of accuracy.

The first and second peristaltic pumps 12, 14 are coplanar, and more particularly the first and second rotors 18, 42 are coplanar. The first and second stators 19, 44 are similarly coplanar. The first and second rotors 18, 42 have rotational axes which are substantially parallel with each other and spaced apart from each other.

The pump housing 16 is typically formed of a moulded substantially rigid plastics material. In the embodiment illustrated in FIGS. 1*a* and 1*b*, the first stator 19, and in particular the first inner wall 19*a*, is formed by the pump housing 16 as a circular recess 62*a* in the pump housing 16. The second stator 44 comprises a stator block 64*a* which is mounted in a complementary shaped recess 66*a* in the pump housing 16. The dimensions of the stator block 64*a* are slightly smaller than the dimensions of the recess 66*a* so that the stator block 64*a* can move laterally in the recess 66*a* and, hence, in the pump housing 16. This lateral movement allows the second stator 44, and its associated second rotor 42, to move relative to the first stator 19, and its associated first rotor 18, in the same plane, as is shown diagrammatically in FIGS. 2*a* to 2*d*. The pumping apparatus 1 includes retaining means (not shown) to retain the stator block 64*a* in the recess 66*a* in the pump housing 16 whilst permitting the aforesaid lateral movement relative to the first stator 19.

Each of the first and second product outlet connectors 40, 60 has an outlet axis which is substantially parallel with the rotational axes of the first and second rotors 18, 42. This enables the pumping apparatus 10, and more particularly the first and second rotors 18, 42, to be easily engaged and disengaged with the first and second external rotary drives 28*a*, 28*b*. This also enables the pumping apparatus 10, and more particularly the first and second product outlet connectors 40, 60, to be engaged with externally mounted first and second product inlet connectors 72*a*, 72*b* (FIGS. 10 and 11). In order to facilitate alignment of the first and second product outlet connectors 40, 60 with the externally mounted first and second product inlet connectors 72*a*, 72*b*, the first and second product outlet connectors 40, 60 are mounted in recesses 74*a*, 74*b* in the pump housing 16 which have a larger diameter than the outer diameter of the respective connectors 40, 60 and which, therefore, allow the connectors 40, 60 to move laterally in the recesses 74*a*, 74*b* in the pump housing 16 in the same plane as the laterally movable second stator 44 and its associated laterally movable second rotor 42.

Figure 3:
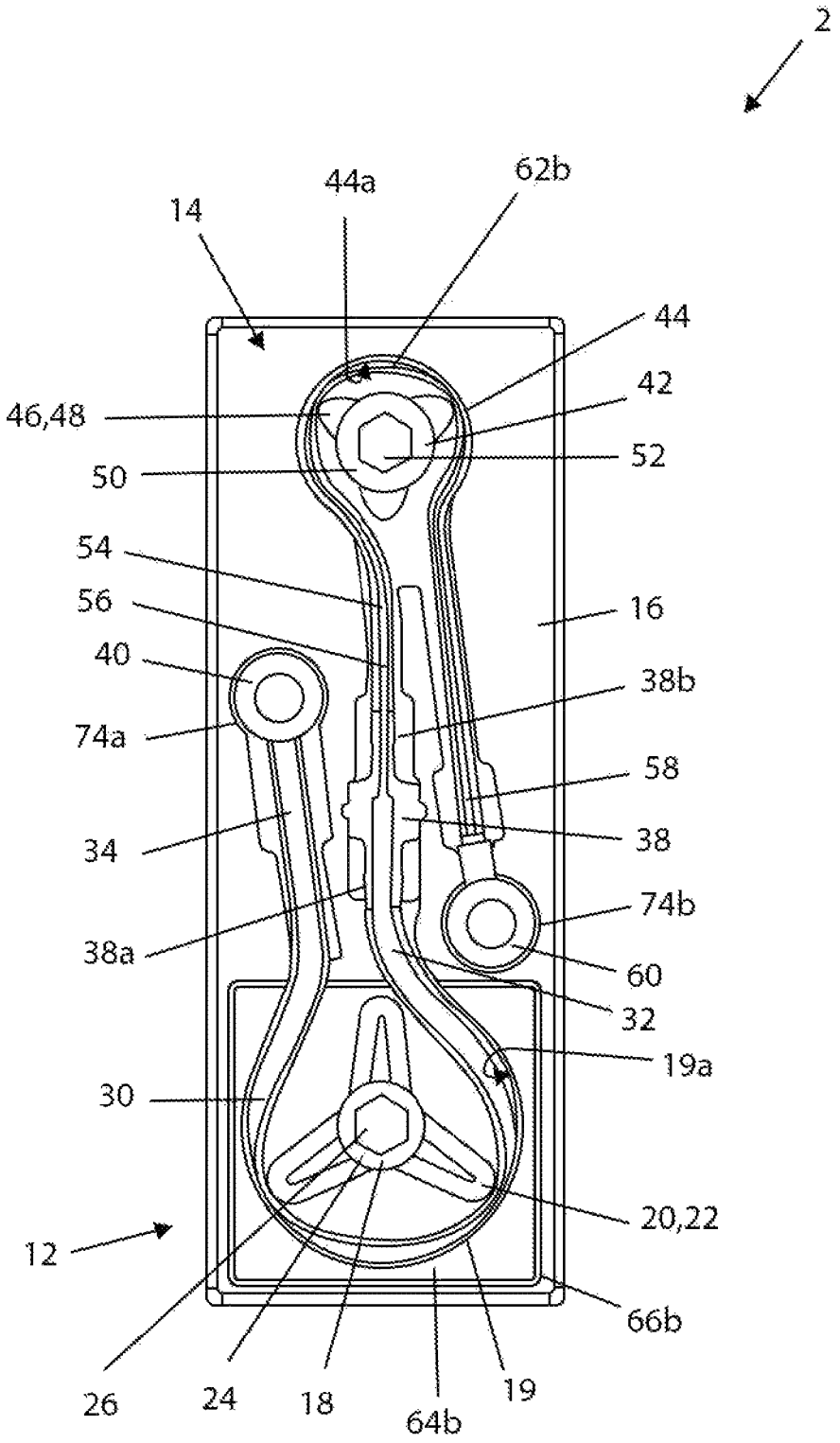
FIG. 3 is a diagrammatic illustration of a second embodiment of a pumping apparatus.

Referring now to FIG. 3, there is shown a second embodiment of a pumping apparatus 2 which is similar to the pumping apparatus 1 described above with reference to FIGS. 1 and 2 and in which corresponding elements are identified using the same reference numerals.

In the pumping apparatus 2, the second stator 44, and in particular the second inner wall 44*a*, is formed by the pump housing 16 as a circular recess 62*b* in the pump housing 16. The first stator 19 comprises a stator block 64*b* which is mounted in a complementary shaped recess 66*b* in the pump housing 16. The dimensions of the stator block 64*b* are slightly smaller than the dimensions of the recess 66*b* so that the stator block 64*b* can move laterally in the recess 66*b* in the pump housing 16. This lateral movement allows the first stator 19, and its associated first rotor 18, to move relative to the second stator 44, and its associated second rotor 42, in the same plane. The pumping apparatus 2 includes retaining means (not shown) to retain the stator block 64*b* in the recess 66*b* in the pump housing 16 whilst permitting the aforesaid lateral movement relative to the second stator 44.

Figure 4:
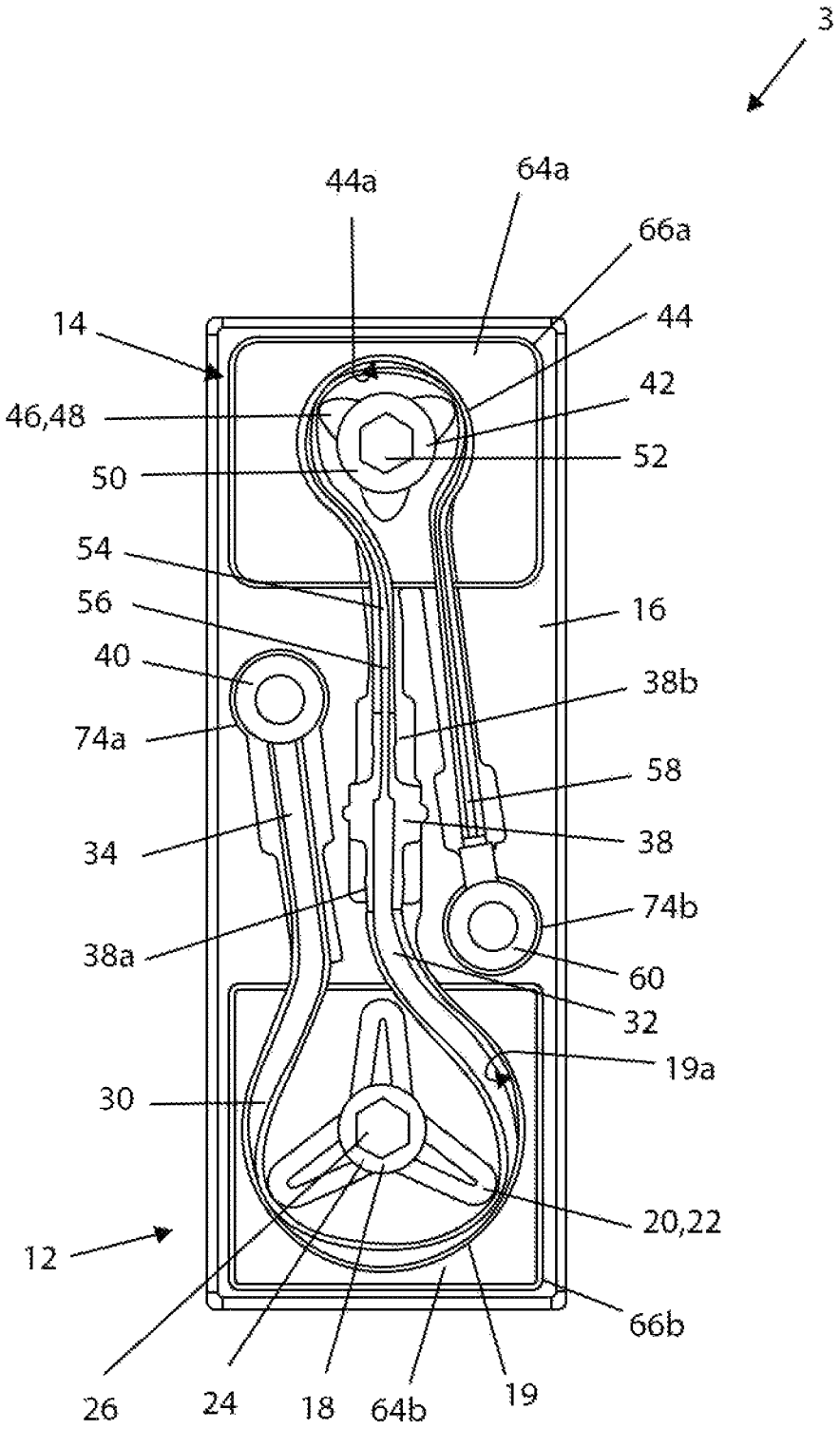
FIG. 4 is a diagrammatic illustration of a third embodiment of a pumping apparatus.

Referring now to FIG. 4, there is shown a third embodiment of a pumping apparatus 3 which is similar to the pumping apparatus 1, 2 described above with reference to FIGS. 1 to 3 and in which corresponding elements are identified using the same reference numerals.

In the pumping apparatus 3, the first stator 19 comprises a stator block 64*b* which is mounted in a complementary shaped recess 66*b* in the pump housing 16. The dimensions of the stator block 64*b* are slightly smaller than the dimensions of the recess 66*b* so that the stator block 64*b* can move laterally in the recess 66*b* in the pump housing 16 as described above. The second stator 44 also comprises a stator block 64*a* which is mounted in a complementary shaped recess 66*a* in the pump housing 16. The dimensions of the stator block 64*a* are slightly smaller than the dimensions of the recess 66*a* so that the stator block 64*a* can move laterally in the recess 66*a* in the pump housing 16 as described above. In this embodiment, it will be understood that the lateral movement of both of the stator blocks 64*a*, 64*b* in their respective recesses 66*a*, 66*b* allows the first and second stators 19, 44, and the associated first and second rotors 18, 42, to move relative to each other in the same plane.

Figure 5:
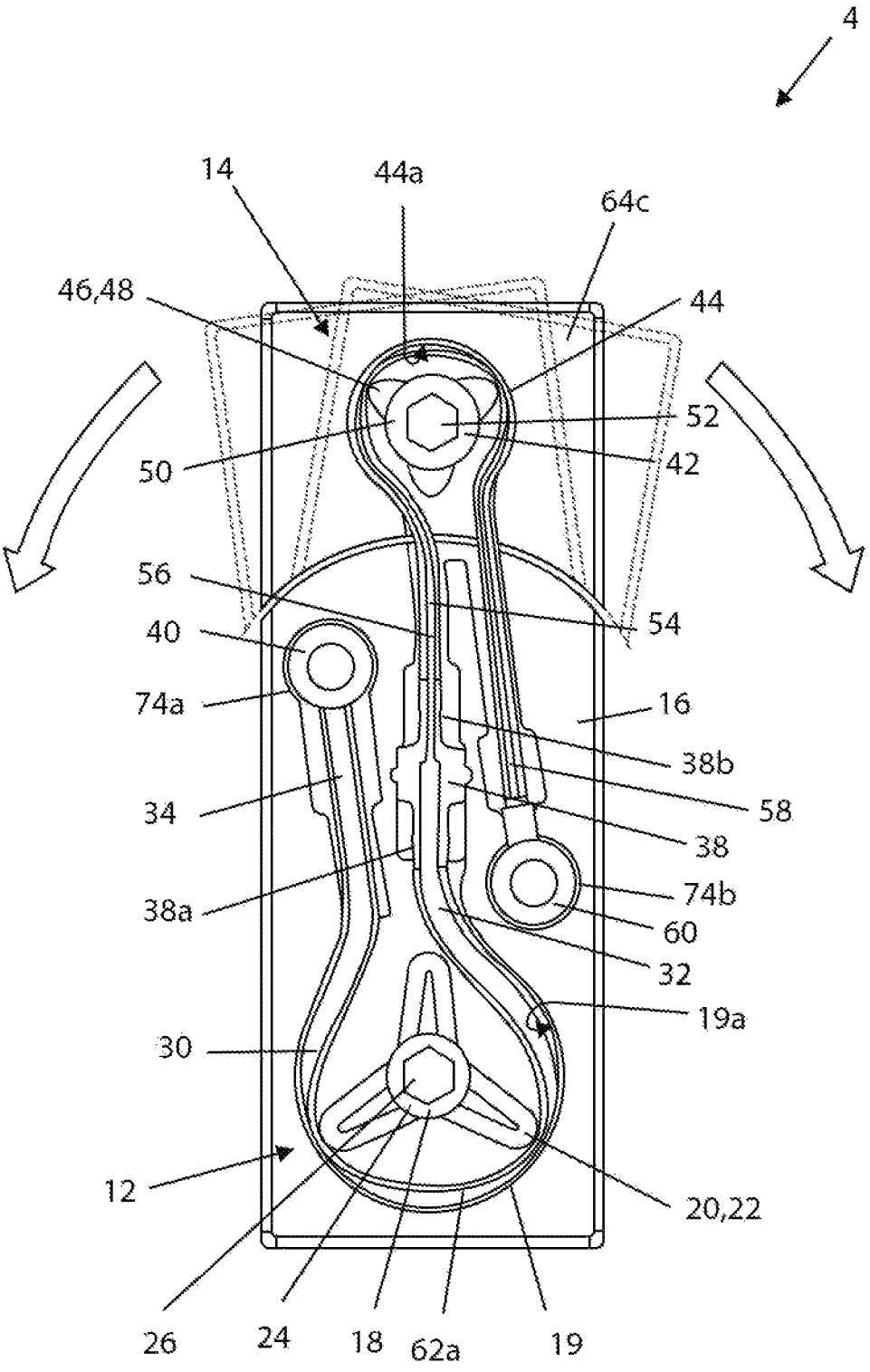
FIG. 5 is a diagrammatic illustration of a fourth embodiment of a pumping apparatus.

Referring now to FIG. 5, there is shown a fourth embodiment of a pumping apparatus 4 which is similar to the pumping apparatus 1 described above with reference to FIGS. 1 and 2 and in which corresponding elements are identified using the same reference numerals.

In the pumping apparatus 4, the first stator 19, and in particular the first inner wall 19*a*, is formed by the pump housing 16 as a circular recess 62*a* in the pump housing 16. The second stator 44 comprises a stator block 64*c* which is mounted on a curved end of the pump housing 16 for lateral movement relative to the pump housing 16 as shown diagrammatically by the arrows in FIG. 5. As before, this lateral movement allows the second stator 44, and its associated second rotor 42, to move relative to the first stator 19, and its associated first rotor 18, in the same plane. The pumping apparatus 4 includes retaining means (not shown) to retain the stator block 64*c* in position on the end of the pump housing 16 whilst permitting the aforesaid lateral movement relative to the pump housing 16 and the first stator 19.

Figure 6:
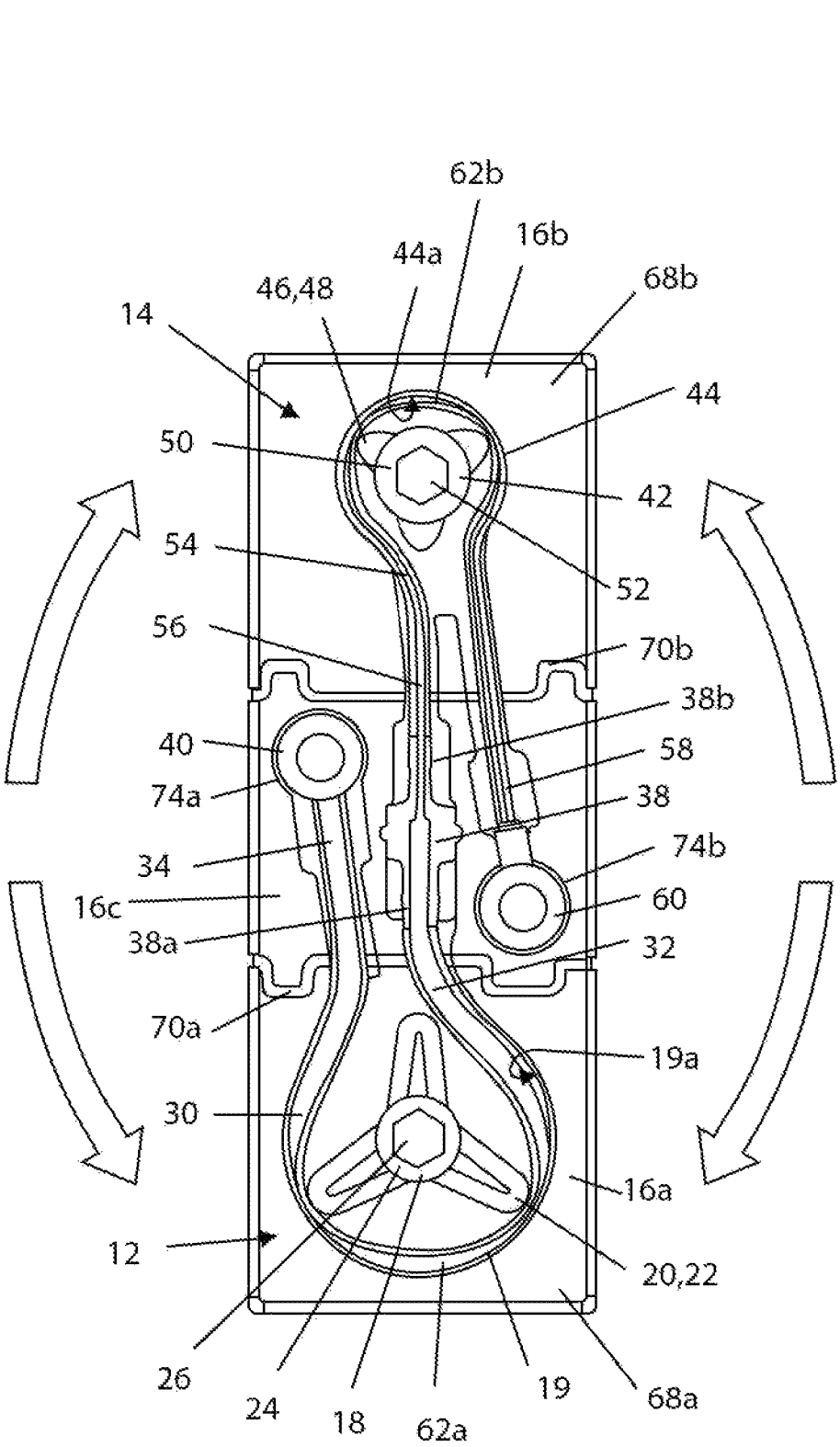
FIG. 6 is a diagrammatic illustration of a fifth embodiment of a pumping apparatus.

Referring now to FIG. 6, there is shown a fifth embodiment of a pumping apparatus 5 which is similar to the pumping apparatus described above and in which corresponding elements are identified using the same reference numerals.

In the pumping apparatus 5, the pump housing 16 comprises first, second and third housing parts 16*a*-16*c*. The first and second stators 19, 44, and in particular their respective first and second inner walls 19*a*, 44*a*, are formed by the first and second housing parts 16*a*, 16*b* as a circular recess 62*a*, 62*b* in the first and second housing parts 16*a*, 16*b*. The first and second housing parts 16*a*, 16*b* are movably mounted on the third housing part 16*c* and are movable relative to each other in the same plane as shown diagrammatically by the arrows in FIG. 6. More particularly, both of the first and second housing parts 16*a*, 16*b* are mounted on opposite ends of the third housing part 16*c* by flexible mountings 70*a*, 70*b* which typically comprise a resilient material such as rubber. The first and second product outlet connectors 40, 60 are mounted on the third housing part 16*c*.

Figure 7:
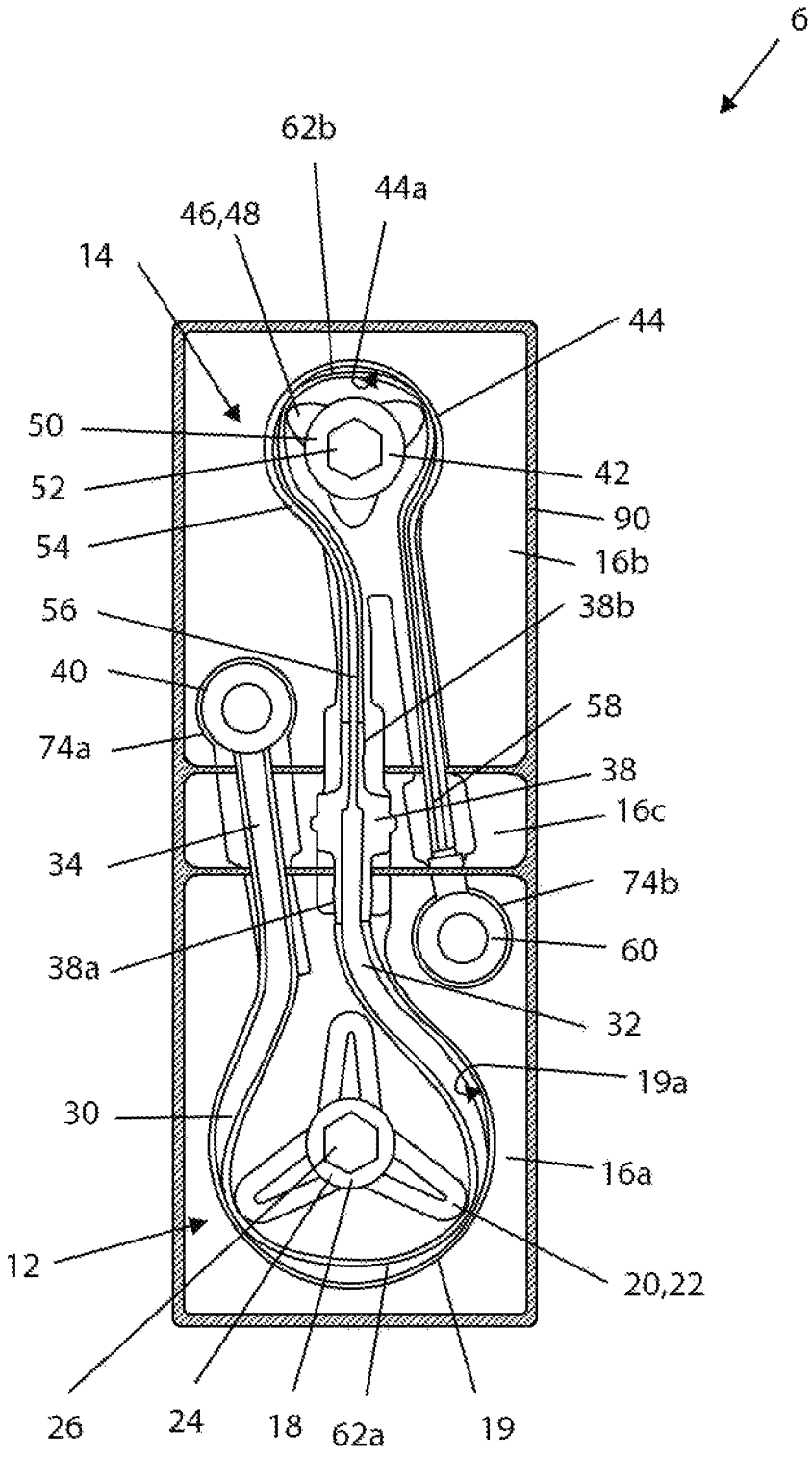
FIG. 7 is a diagrammatic illustration of a sixth embodiment of a pumping apparatus.

Referring now to FIG. 7, there is shown a sixth embodiment of a pumping apparatus 6 which is similar to the pumping apparatus 5 described above with reference to FIG. 6 and in which corresponding elements are identified using the same reference numerals.

In the pumping apparatus 6, the pump housing 16 comprises first, second and third housing parts 16*a*-16*c*. The first and second stators 19, 44, and in particular their respective first and second inner walls 19*a*, 44*a*, are formed by the first and second housing parts 16*a*, 16*b* as a circular recess 62*a*, 62*b* in the first and second housing parts 16*a*, 16*b*. The first product outlet connector 40 is mounted on the second housing part 16*b* and the second product outlet connector 60 is mounted on the first housing part 16*a*.

The first, second and third housing parts 16*a*-*c* are mounted for movement relative to each other in the same plane in a chassis or resilient mount 90, which typically comprises a resilient material such as rubber.

Figure 8:
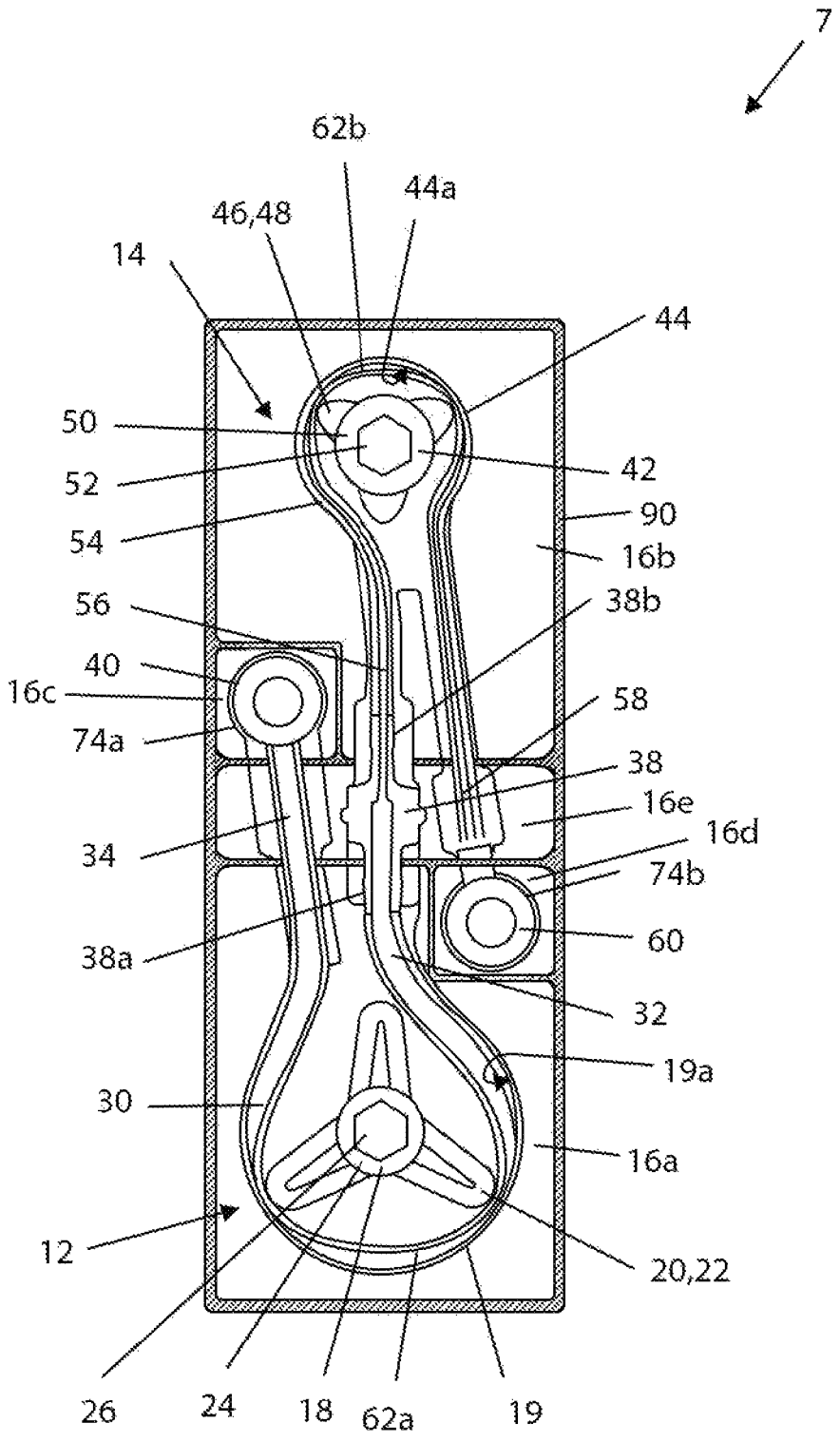
FIG. 8 is a diagrammatic illustration of a seventh embodiment of a pumping apparatus.

Referring now to FIG. 8, there is shown a seventh embodiment of a pumping apparatus 7 which is similar to the pumping apparatus 6 described above with reference to FIG. 7 and in which corresponding elements are identified using the same reference numerals.

In the pumping apparatus 7, the pump housing 16 comprises first to fifth housing parts 16*a*-16*e*. The first and second stators 19, 44, and in particular their respective first and second inner walls 19*a*, 44*a*, are formed by the first and second housing parts 16*a*, 16*b* as a circular recess 62*a*, 62*b* in the first and second housing parts 16*a*, 16*b*. The first product outlet connector 40 is mounted on the third housing part 16*c* and the second product outlet connector 60 is mounted on the fourth housing part 16*d*.

The housing parts 16*a*-*e* are mounted for movement relative to each other in the same plane in a chassis or resilient mount 90, which typically comprises a resilient material such as rubber.

Figure 9:
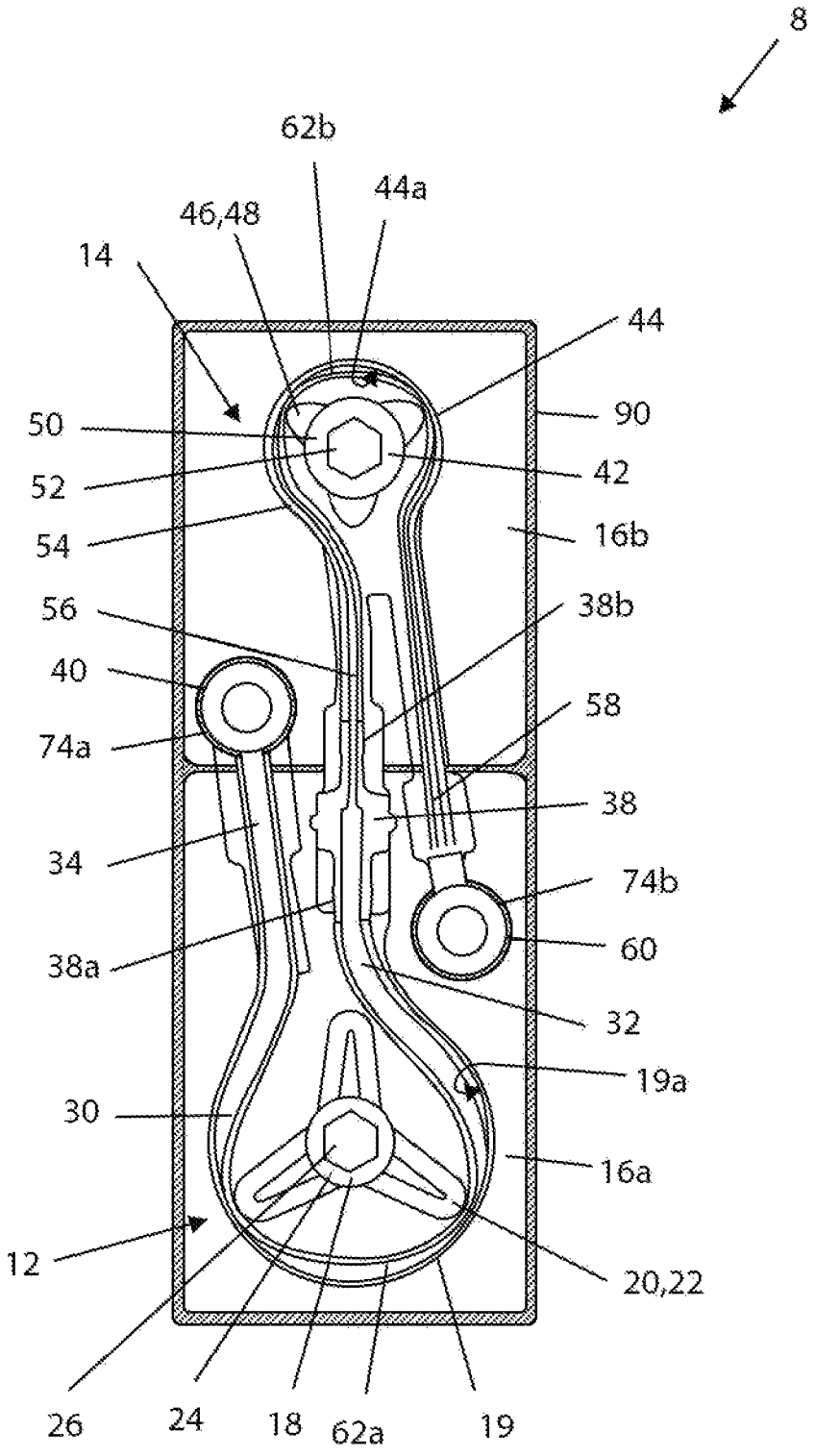
FIG. 9 is a diagrammatic illustration of an eighth embodiment of a pumping apparatus.

Referring now to FIG. 9, there is shown an eighth embodiment of a pumping apparatus 8 which is similar to the pumping apparatus described above and in which corresponding elements are identified using the same reference numerals.

In the pumping apparatus 8, the pump housing 16 comprises first and second housing parts 16*a*, 16*b*. The first and second stators 19, 44, and in particular their respective first and second inner walls 19*a*, 44*a*, are formed by the first and second housing parts 16*a*, 16*b* as a circular recess 62*a*, 62*b* in the first and second housing parts 16*a*, 16*b*. The first and second housing parts 16*a*, 16*b* are mounted for movement relative to each other in the same plane in a chassis or resilient mount 90, which typically comprises a resilient material such as rubber.

The first and second product outlet connectors 40, 60 are also independently mounted for movement relative to each other and relative to the first and second stators 19, 44 in the chassis or resilient mount 90.

Figure 10A:
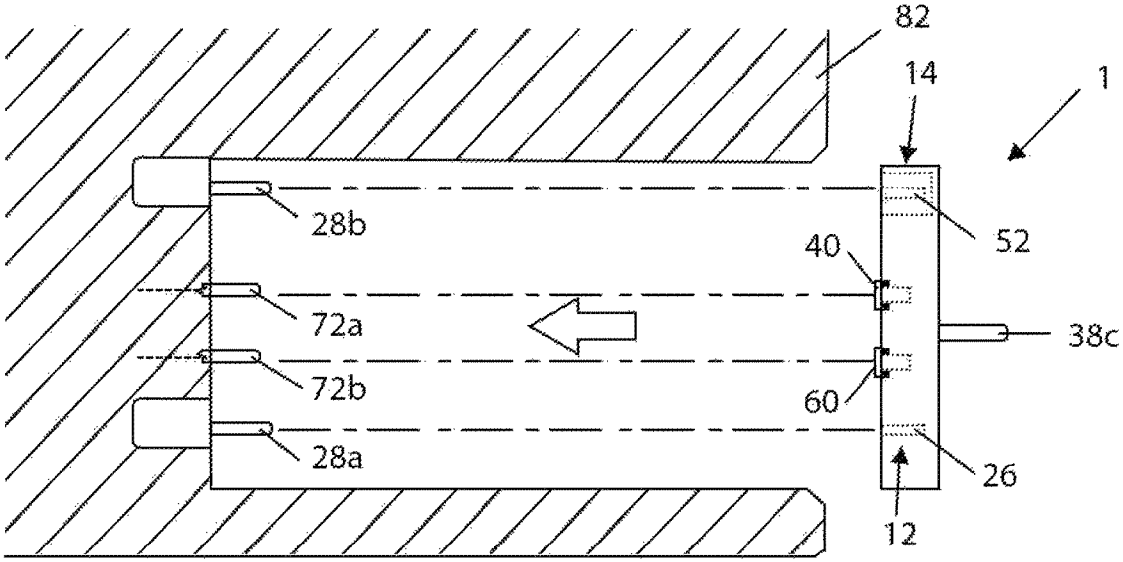
FIGS. 10*a* and 10*b* are diagrammatic illustrations of the first embodiment of the pumping apparatus shown in FIGS. 1*a* and 1*b* in conjunction with a removably connectable single flowable product source.
Figure 10B:
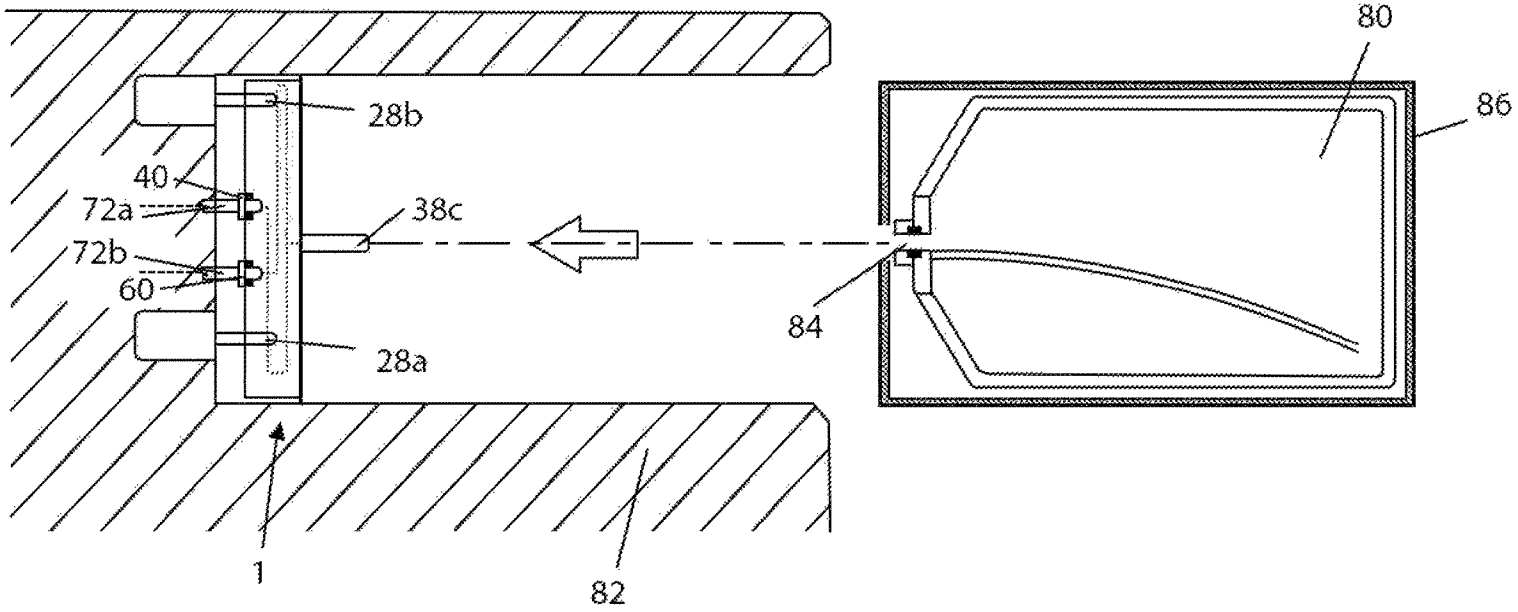
Figure 11:
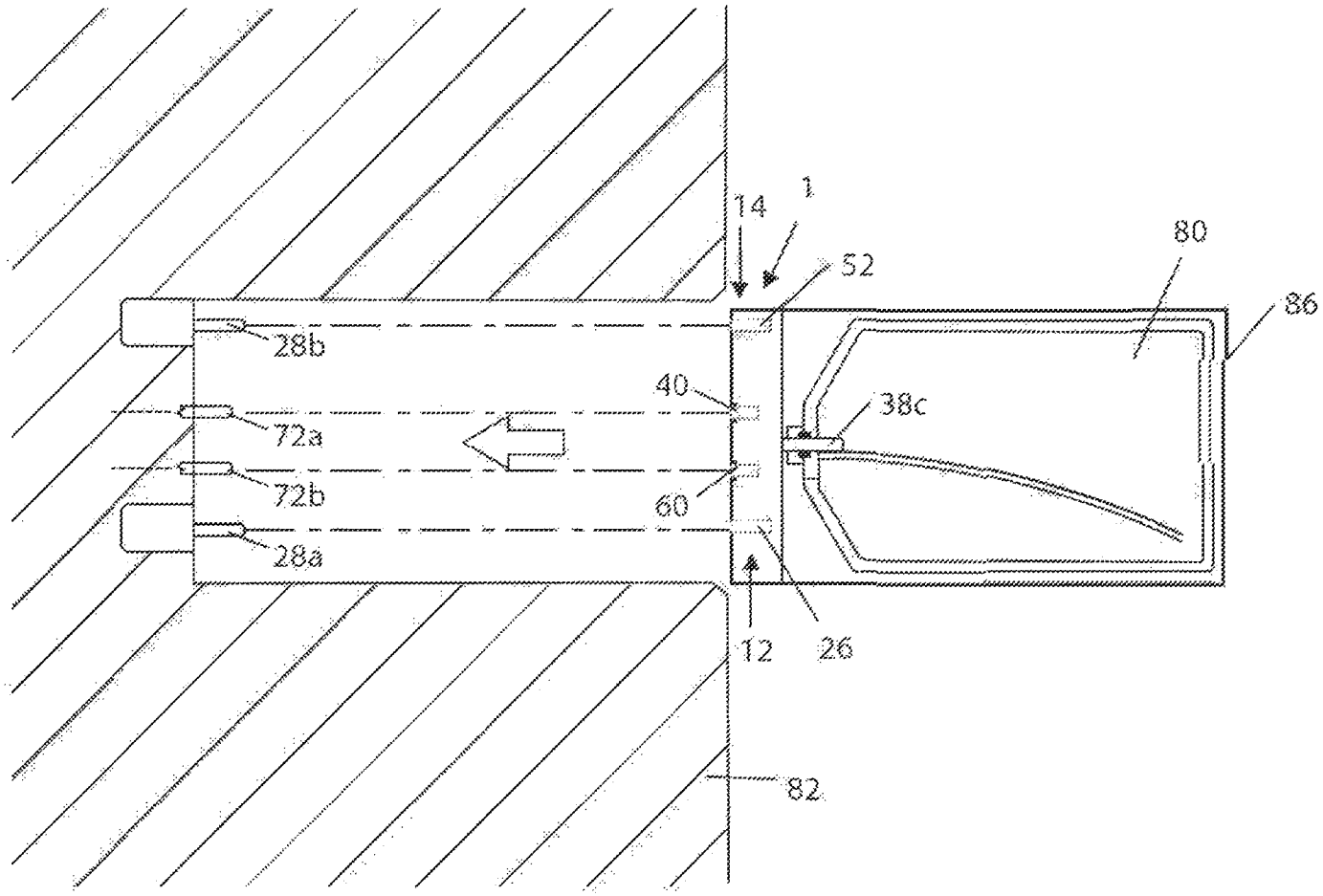
FIG. 11 is a diagrammatic illustration of the first embodiment of the pumping apparatus shown in FIGS. 1*a* and 1*b* in conjunction with a connected single flowable product source.

Referring now to FIGS. 10*a* and 10*b*, in a first example the pumping apparatus 1 is removably connectable to an air-tight flexible pouch 80 containing a flowable product. In order to deliver flowable product from the flexible pouch 80, the pumping apparatus 1 can be initially positioned on a dispensing apparatus 82 as shown schematically in FIG. 10*a*. During positioning, the central drive apertures 26, 52 in the first and second spindles 24, 50 of the first and second rotors 18, 42 are engaged respectively with the first and second external rotary drives 28*a*, 28*b*. Correct engagement of the first and second external rotary drives 28*a*, 28*b* with the central drive apertures 26, 52 is assured due to the fact that the second stator 44, and hence the second rotor 42, can move laterally relative to the first stator 19, and hence the first rotor 18.

The first and second product outlet connectors 40, 60 are also engaged respectively with the externally mounted first and second product inlet connectors 72*a*, 72*b* during positioning of the pumping apparatus 1 on the dispensing apparatus 82. As explained above, alignment and engagement of the first and second product outlet connectors 40, 60 with the first and second product inlet connectors 72*a*, 72*b* is assured due to the fact that the first and second product outlet connectors 40, 60 can move laterally in the oversized recesses 74*a*, 74*b* in the pump housing 16.

Once the pumping apparatus 1 has been positioned on the dispensing apparatus 82 as shown in FIG. 10*b*, the flexible pouch 80 can be connected to the pumping apparatus 1, and in particular an outlet 84 of the flexible pouch 80 can be connected to an inlet port 38*c* of the outlet manifold 38. The outlet manifold 38 ensures that the inlet side 32 of the first flexible tubing 30 and the inlet side 56 of the second flexible tubing 54 are both in simultaneous fluid communication with the flowable product in the flexible pouch 80. The flexible pouch 80 can be mounted in a rigid container 86, for example formed of corrugated cardboard, but it will be understood that this is not strictly necessary.

Referring now to FIG. 11, in a second example the pumping apparatus 1 is connected to an air-tight flexible pouch 80 containing a flowable product in the manner described above with reference to FIGS. 10*a* and 10*b*. In this second example, both the pumping apparatus 1 and the connected flexible pouch 80 are positioned in a rigid container 86 which again may be formed of a corrugated cardboard material.

In order to deliver flowable product from the flexible pouch 80, the rigid container 86 is positioned on a dispensing apparatus 82 as shown schematically in FIG. 11. During positioning, the central drive apertures 26, 52 in the first and second spindles 24, 50 of the first and second rotors 18, 42 are engaged respectively with the first and second external rotary drives 28*a*, 28*b*. Correct engagement of the first and second external rotary drives 28*a*, 28*b* with the central drive apertures 26, 52 is assured due to the fact that the second stator 44, and hence the second rotor 42, can move laterally relative to the first stator 19, and hence the first rotor 18.

The first and second product outlet connectors 40, 60 are also engaged respectively with the externally mounted first and second product inlet connectors 72*a*, 72*b* during positioning of the rigid container 86 on the dispensing apparatus 82. As explained above, alignment and engagement of the first and second product outlet connectors 40, 60 with the first and second product inlet connectors 72*a*, 72*b* is assured due to the fact that the first and second product outlet connectors 40, 60 can move laterally in the oversized recesses 74*a*, 74*b* in the pump housing 16.

Figure 12:
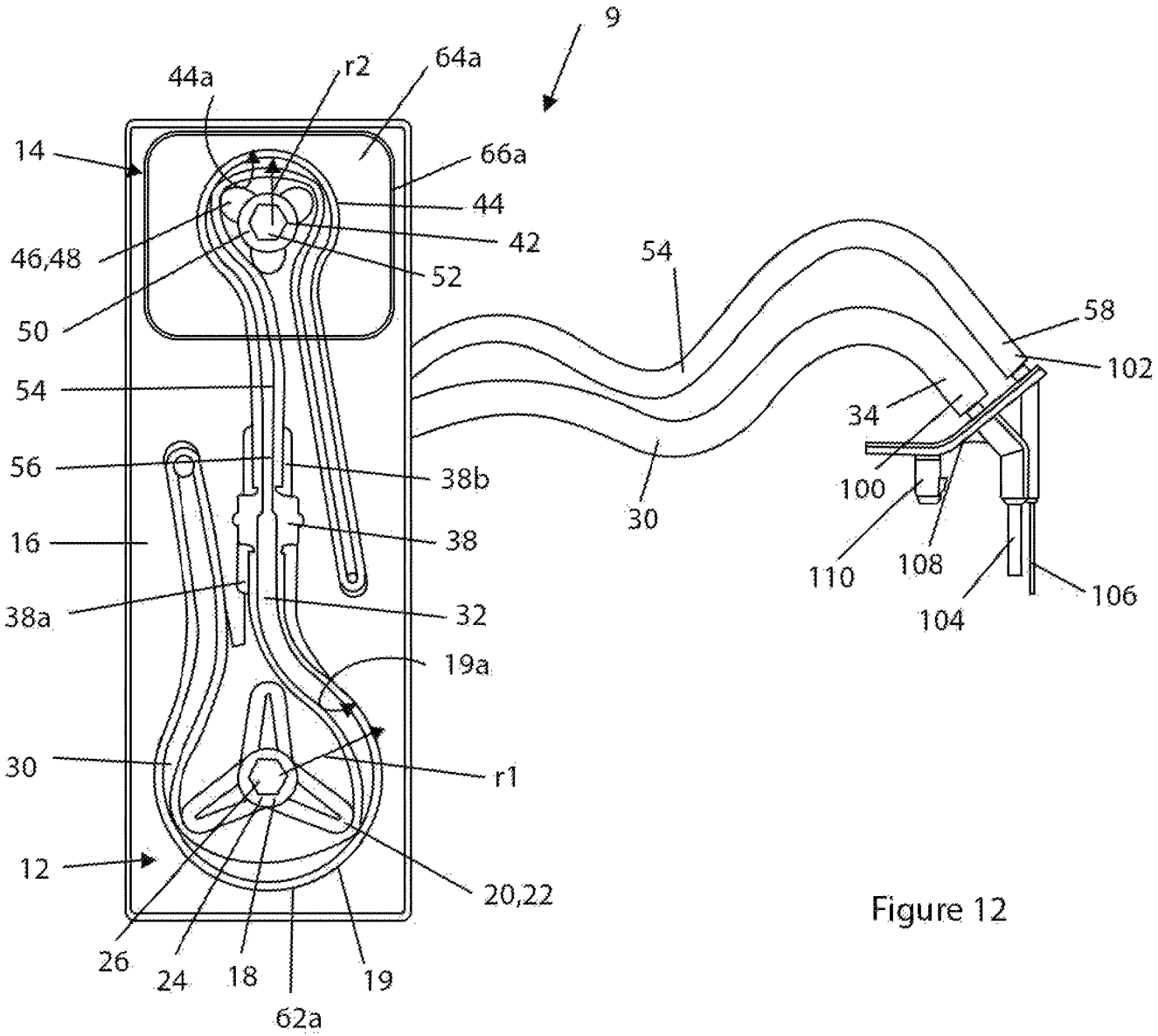
FIG. 12 is a diagrammatic illustration of a ninth embodiment of a pumping apparatus.

Referring now to FIG. 12, there is shown a ninth embodiment of a pumping apparatus 9 which is similar to the pumping apparatus 1 described above with reference to FIGS. 1 and 2 and in which corresponding elements are identified using the same reference numerals.

In the pumping apparatus 9, the first and second flexible tubing 30, 54 include respectively first and second product outlets 100, 102 in the form of first and second dispensing needles 104, 106 at their outlet sides 34, 58. The first and second dispensing needles 104, 106 form a dispensing unit 108 which can be mounted on a support (not shown) by a mounting element 110 such that the first and second dispensing needles 104, 106 can dispense flowable product directly into a common receptacle.

The first dispensing needle 104 has a diameter, and in particular an inner diameter, which is greater than the diameter, and in particular the inner diameter, of the second dispensing needle 106. It will be understood that the larger diameter first dispensing needle 104 is suited to dispensing large quantities of liquid or other flowable product in a relatively short amount of time during operation of the larger first pump 12 with its larger diameter first flexible tubing 30 whereas the smaller diameter second dispensing needle 106 is suited to dispensing smaller quantities of the liquid or other flowable product but with a higher degree of accuracy during operation of the smaller second pump 14 with its smaller diameter second flexible tubing 54.

Figure 13:
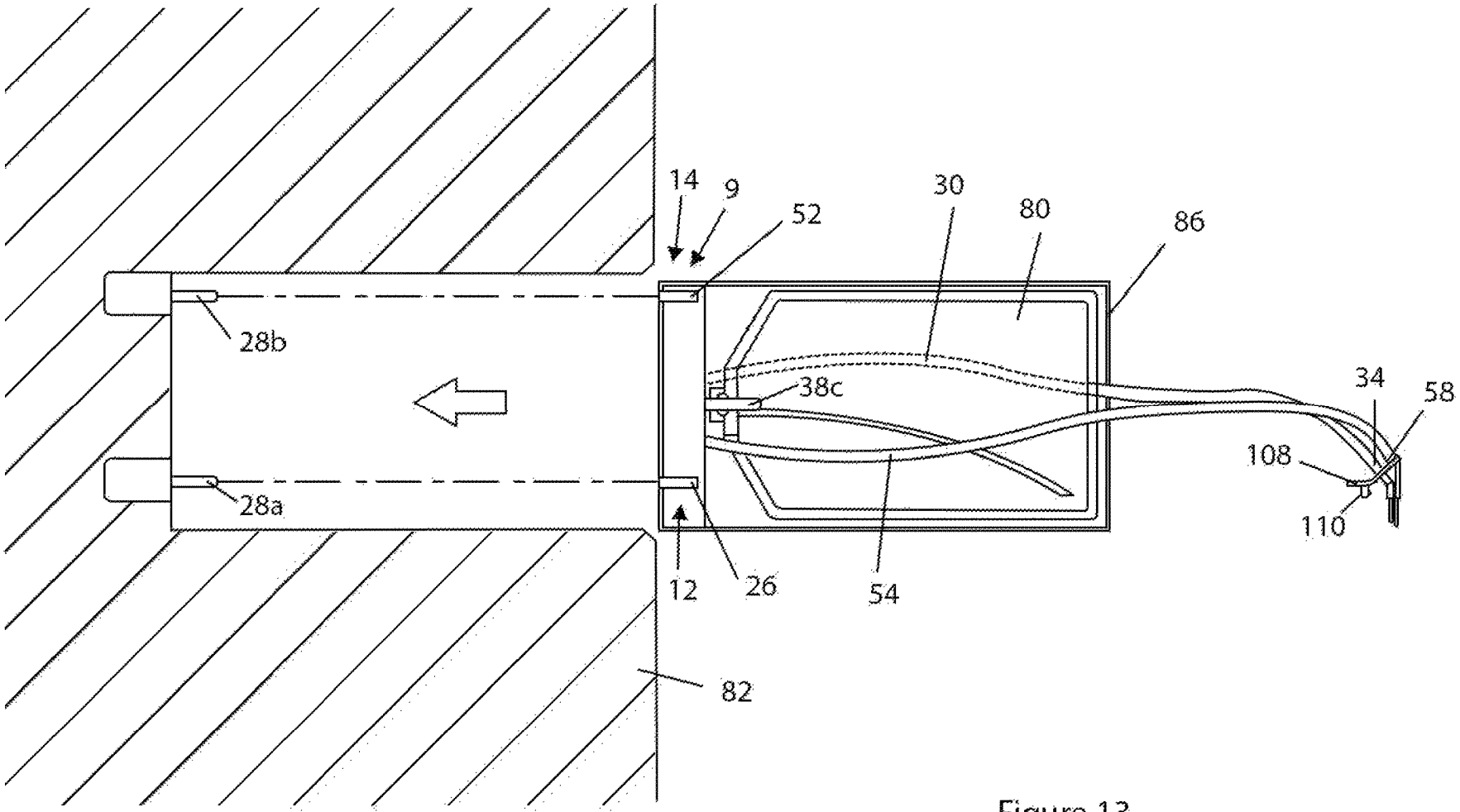
FIG. 13 is a diagrammatic illustration of the ninth embodiment of the pumping apparatus shown in FIG. 12 in conjunction with a connected single flowable product source.

Referring now to FIG. 13, the pumping apparatus 9 is connected to an air-tight flexible pouch 80 containing flowable product in the same manner described above with reference to FIG. 11.

In order to deliver flowable product from the flexible pouch 80, the rigid container 86 is positioned on a dispensing apparatus 82 as shown schematically in FIG. 13. During positioning, the central drive apertures 26, 52 in the first and second spindles 24, 50 of the first and second rotors 18, 42 are engaged respectively with the first and second external rotary drives 28*a*, 28*b*. As explained above, correct engagement of the first and second external rotary drives 28*a*, 28*b* with the central drive apertures 26, 52 is assured due to the fact that the second stator 44, and hence the second rotor 42, can move laterally relative to the first stator 19, and hence the first rotor 18.

The first and second flexible tubing 30, 54 advantageously extend away from the first and second pumps 12, 14 through the rigid container 86 and alongside the flexible pouch 80 so that they do not impede engagement of the first and second external rotary drives 28*a*, 28*b* with the central drive apertures 26, 52. As noted above, the dispensing unit 108 comprising the first and second dispensing needles 104, 106 can be mounted on a support (not shown) by engaging the mounting element 110 with the support.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. A pumping apparatus for dispensing a flowable product, the apparatus comprising:

a first peristaltic pump comprising:

a first drivable rotor having at least one pressing member;

a first cylindrical stator in which the first drivable rotor is rotatable, the first cylindrical stator having a first circumferential inner wall with a first radius;

first flexible tubing having an inlet side and an outlet side, the first flexible tubing extending circumferentially around the first cylindrical stator against the first circumferential inner wall;

a second peristaltic pump comprising:

a second drivable rotor having at least one pressing member;

a second cylindrical stator in which the second drivable rotor is rotatable, the second cylindrical stator having a second circumferential inner wall with a second radius;

second flexible tubing having an inlet side and an outlet side, the second flexible tubing extending circumferentially around the second cylindrical stator against the second circumferential inner wall;

wherein the first radius is greater than the second radius and at least one of the stators is movable horizontally and vertically relative to the other stator during pumping via the pumping apparatus.

2. The pumping apparatus of claim 1, further comprising a pump housing.

3. The pumping apparatus of claim 2, wherein at least one of the stators is mounted on or in the pump housing for movement relative to the other stator.

4. The pumping apparatus of claim 2, wherein both of the stators are mounted on or in the pump housing for movement relative to each other.

5. The pumping apparatus of claim 2, wherein at least one of the stators is formed by the pump housing and the other stator is mounted on or in the pump housing for movement relative to the pump housing.

6. The pumping apparatus of claim 2, wherein the at least one movable stator comprises a stator block that is movable relative to the pump housing.

7. The pumping apparatus of claim 6, wherein the apparatus comprises retaining means for retaining the stator block on or in the pump housing, the retaining means being arranged to permit movement of the stator block relative to the pump housing.

8. The pumping apparatus of claim 1, wherein the pump housing comprises first and second housing parts which are movable relative to each other and the first and second stators are formed by the first and second housing parts.

9. The pumping apparatus of claim 1, wherein the first flexible tubing and the second flexible tubing have the same inner diameter.

10. The pumping apparatus of claim 1, wherein the first flexible tubing and the second flexible tubing have a different inner diameter.

11. The pumping apparatus of claim 10, wherein the inner diameter of the first flexible tubing is greater than the inner diameter of the second flexible tubing.

12. The pumping apparatus of claim 1, wherein the apparatus comprises a first product outlet connector at the outlet side of the first flexible tubing and having an outlet axis, a second product outlet connector at the outlet side of the second flexible tubing and having an outlet axis, the outlet axes of the first and second product outlet connectors are substantially parallel with the rotational axes of the first and second rotors, and the first and second product outlet connectors are mounted on or in the pump housing and movable relative to the pump housing.

13. The pumping apparatus of claim 1, wherein the first flexible tubing includes a first product outlet at the outlet side thereof, the second flexible tubing includes a second product outlet at the outlet side thereof, and the first and second product outlets are configured to dispense the flowable product directly into a receptacle.

14. The pumping apparatus of claim 13, wherein the first product outlet and the second product outlet have the same inner diameter.

15. The pumping apparatus of claim 13, wherein the first product outlet and the second product outlet have a different inner diameter.

16. The pumping apparatus of claim 15, wherein the inner diameter of the first product outlet is greater than the inner diameter of the second product outlet.

17. The pumping apparatus of claim 1, further comprising a single flowable product source, wherein the inlet side of the first flexible tubing and the inlet side of the second flexible tubing are each in fluid communication with the single flowable product source.

18. The pumping apparatus according to claim 17, wherein the single flowable product source comprises a flowable product reservoir.

19. The pumping apparatus according to claim 17, wherein the single flowable product source comprises an air-tight flexible pouch containing the flowable product.

20. The pumping apparatus of claim 1, further comprising a first flowable product source and a second flowable product source not in fluid communication with the first flowable product source, wherein:

the inlet side of the first flexible tubing is in fluid communication with the first flowable product source; and the inlet side of the second flexible tubing is in fluid communication with the second flowable product source.

* * * * *